US011344759B2

(12) United States Patent
Slavkovic

(10) Patent No.: US 11,344,759 B2
(45) Date of Patent: May 31, 2022

(54) FIRE EXTINGUISHING POWDER FOR A, B, C, D, F AND K CLASS FIRES AND ITS APPLICATION IN SUPPRESSION OF CATASTROPHIC FIRES, THE ABSORPTION OF OIL AND ITS DERIVATIVES AND REVITALIZATION OF LAND DEGRADATION CAUSED BY FIRE

(71) Applicants: George Bogdanovic, Wilmington, DE (US); Ljubisa Slavkovic, Kraljevo (RS)

(72) Inventor: Ljubisa Slavkovic, Kraljevo (RS)

( * ) Notice: Subject to any disclaimer, the term of this patent is extended or adjusted under 35 U.S.C. 154(b) by 0 days.

(21) Appl. No.: 16/970,723

(22) PCT Filed: Jul. 9, 2018

(86) PCT No.: PCT/RS2018/000009
§ 371 (c)(1),
(2) Date: Aug. 18, 2020

(87) PCT Pub. No.: WO2019/164415
PCT Pub. Date: Aug. 29, 2019

(65) Prior Publication Data

US 2020/0406081 A1 Dec. 31, 2020

(30) Foreign Application Priority Data

Feb. 21, 2018 (RS) ..... P-2018/0203

(51) Int. Cl.
*A62D 1/00* (2006.01)
*A62D 101/00* (2007.01)

(52) U.S. Cl.
CPC ..... *A62D 1/0014* (2013.01); *A62D 2101/00* (2013.01)

(58) Field of Classification Search
None
See application file for complete search history.

(56) References Cited

U.S. PATENT DOCUMENTS 3,238,129 A 3/1966 Veltman
3,531,407 A 9/1970 Phillips et al.
(Continued)

FOREIGN PATENT DOCUMENTS

CA 607 371 10/1960
GB 1601017 10/1981

OTHER PUBLICATIONS

International Search Report issued by the International Searching Authority (ISA/O.E.P.M.) dated Feb. 27, 2019 in connection with International Application No. PCT/RS2018/000009.
(Continued)

*Primary Examiner* — Joseph D Anthony
(74) *Attorney, Agent, or Firm* — Gary J. Gershik

(57) ABSTRACT

Fire extinguishing powder for extinguishing of A, B, C, D, F and K classes of fire is obtained in the fine grinding procedure by a "micronizer" to the structure of 50 microns of zeolite, vermiculite, aluminum hydrate, sepiolite, calcite, talk and alumina, and then mixed in the covered mixer for 30 minutes until the homogenized powder is obtained, successful for extinguishing the A, B, C, D, F and K classes of fire and especially catastrophic fires, oil absorption and its derivates and revitalization of land degradation caused by fire, where the distribution of the powder in question to the place of fire, except the devices S-1, S-2, S-3, S-6, S-9, S-12, S-50 and S-100, is performed by the military and civil planes, with the notice that the powder in question, due to its natural components it is made of, is completely non-harmful for humans, animals, plans and treated area, and besides that, it has a great extinguishing power, with almost instantaneous flame elimination.

4 Claims, 1 Drawing Sheet

(56) References Cited

U.S. PATENT DOCUMENTS

| | | | | |
|---|---|---|---|---|
| 5,609,210 | A * | 3/1997 | Galbraith | A62C 35/023 169/26 |
| 9,410,087 | B2 * | 8/2016 | Pascal | D21H 21/34 |
| 9,426,984 | B2 * | 8/2016 | Pascal | C04B 30/02 |
| 2013/0274347 | A1 * | 10/2013 | Pascal | C04B 30/02 514/770 |
| 2014/0343198 | A1 | 11/2014 | Palaikis et al. | |
| 2015/0044483 | A1 * | 2/2015 | Parker | C09J 197/02 428/447 |
| 2015/0368560 | A1 * | 12/2015 | Pascal | D21H 21/36 106/18.12 |

OTHER PUBLICATIONS

Database WPI, database accession No. 2014-J18801.

* cited by examiner

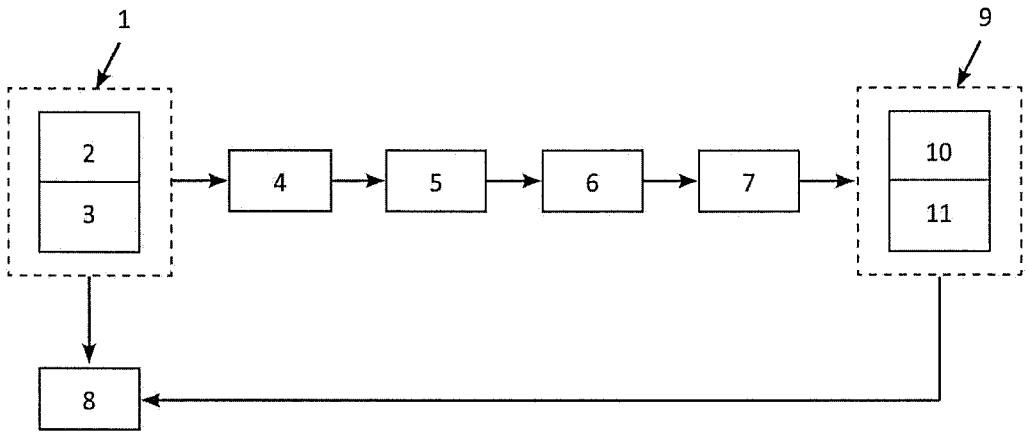
1
9
2
3
4
5
6
7
10
11
8

FIRE EXTINGUISHING POWDER FOR A, B, C, D, F AND K CLASS FIRES AND ITS APPLICATION IN SUPPRESSION OF CATASTROPHIC FIRES, THE ABSORPTION OF OIL AND ITS DERIVATIVES AND REVITALIZATION OF LAND DEGRADATION CAUSED BY FIRE

RELATED APPLICATIONS

This application is a § 371 national stage of PCT International Application No. PCT/RS2018/000009, filed Jul. 9, 2018, claiming priority of Serbian Patent Application No. P-2018/0203, filed Feb. 21, 2018, the contents of each of which are hereby incorporated by reference into this application.

TECHNICAL FIELD

The subject matter of this invention is generally in the field of chemistry, and specifically refers to fire extinguishing powder for A, B, C, D and K class fires and its application in suppression of catastrophic fires, the absorption of fires and its derivates and revitalization of land degradation caused by fire.

According to the International Patent Classification (ICP) Int.cl. 2017.01 the processing subject has been classified and marked with the basic classification symbol A62D 1/00, which defines fire extinguishing compositions and the use of chemical substances for fire extinguishing, in addition, it can be marked by secondary classification symbol C09K 3/00 defining substances that are not intended elsewhere.

As the invention is determined for a method of use according to which the mentioned powder is used by using the modified cluster bombs and patrons to distribute to the fire affected area, this invention may be marked by an additional secondary classification symbol F42B 39/16 which defines the packaging and storage of ammunition or explosive charge for extinguishing fire.

Technical Problem

The technical issue solved by the present invention consists of the following: how to make a mixture whose active principles, the natural components which it is made of, completely or substantially, enable the extinguishing of all types of fire of class A, B, C, D, F or K, with increased fire extinguishing capability, higher coverage power, durability to moisture and total environmental effect i.e. harmless to humans, animals and without harmful effects on the environment, and that it is particularly useful for combating and suppression catastrophic fires, especially forest fires, as well as for absorption of harmful organic material in the event of an accidental situation by absorbing the material from the place of the fire, and then removing it or sending it for recycling, whereby the powder used due to the ecological components of which it is made of after extinguishing, is successfully used for the revitalization of the land, and it is also suitable for filling S-appliances, other mobile and stationary appliances of larger capacities, modified cluster bombs, "bombs" with housings of biodegradable plastic, that is, cartridges for transport to the areas affected by fire, and other special packages for fire extinguishing appliances intended for home, catering, manufacturing, commercial objects, institutions and other facilities where the need for ecological requirements is emphasized.

BACKGROUND ART

It is well known that the fire occurs when the heat-producing matter is heated in the presence of oxygen. In this way, the temperature of the heated substance increases and when it reaches the ignition temperature the fire occurs. It is also known that this temperature can be achieved in several ways: a) by burning the matter or object: by direct contact with flame or hot matter; b) chemical reactions between elements and compounds and chemical or biological degradation of individual matters c) by switching electricity into heat energy: using electricity, atmospheric discharge and static electricity discharge.

The fires vary according to the place of origin, type of burning material, volume, stage of development, etc. According to the place of production, they are divided into internal and external fires. According to the type of fuels according to the European classification fires are classified into five classes: A, B, C, D and F.

Class A—includes fires of solid materials burning with flame and ember, e.g. wood, paper, fabrics and similar materials. Class A fires are best to be extinguished by water.

Class B—includes flames by flammable liquids that do not mix with water, for ex. oil and petroleum products, thinners, paints, varnishes, oils, grease, etc. For fire extinguishing we use powder, carbon dioxide or foam.

Class C—includes fuels of fuel gases, e.g. methane, propane, butane, acetylene, etc. For their extinguishing, powder and carbon dioxide are most commonly used.

Class D—includes fires of light metals, e.g. aluminum, magnesium and their alloys. Only dry materials are used for extinguishing (special types of powder, dry quartz sand, gray cast iron).

Class F—includes fires of vegetable and animal oils and fats such as oil and grease from deep fryers, kitchen appliances for frying and baking, etc.

Today it is accepted that the burning process is directly related to the motion of molecules in the matter and depends on the distance between them and their mutual forces of attraction, so-called cohesion forces. It is known that these forces are the highest in solid bodies and the lowest in the gases, and therefore we say that the solid-state molecules "blink", i.e., they just move by oscillation. Hereby we can conclude that heating the body actually influences the speed of movement of the molecules in it, i.e. that it increases by bringing the heat, or that the removal of heat from the body decreases the velocity of the molecule in it. The size that characterizes the internal kinetic energy of a substance is called the temperature. In order for the burning process to take place it is necessary to meet the following conditions: the presence of a substance that can burn (flammable matter), the presence of the substance that contributes to the combustion (oxygen), and the heat energy for the temperature reach for the ignition of flammable matter.

If any of these conditions is eliminated or we reduce its presence, the possibility of the fire is significantly reduced, the combustion becomes incomplete, and the fire hazard is reduced to a minimum.

With the development of technology, the fire extinguishing powder has become one of the most present forms in the battle to prevent and extinguish the fire. Initially, the use of powder was limited to hand-held fire-extinguishers, and further development of the fire-extinguishing technique enabled the introduction of stable processes of large capacity, with automatic activation, which contain the components in the powder that improve the properties of the powder flow through the pipe. Today we distinguish two types of powder for fire extinguishing:

a) sodium bicarbonate based powder, potassium bicarbonate widely used for extinguishing B, C, E fires, b) sodium sulfate, ammonium sulfate, ammonium phosphate based powder etc. which are used for extinguishing the fire with powder where there is a fire, i.e. class A fires.

At a) and b) powders, the percentage of the individual chemicals mentioned above ranges from min. 30% to over 90%.

The powder has the advantage of extinguishing many types of fire because the fire is extinguished quickly by it and with much less damaging consequences, which is an advantage in relation to water. In practice, powders for general and special purposes are used for extinguishing. Common powders can be divided into "BC" powders (sodium bicarbonate, potassium carbonate, potassium sulfate, potassium carbonate and additives) and "ABC" powders. "BC" powder is intended for extinguishing the class B "fire" (liquid or solid matter that passes into liquid state at elevated temperatures) and "C" (gases) class. "ABC" powder is intended for extinguishing fires of class "A" (solid matter forming a hot ember), class "B" and class "C".

A review of the available domestic and foreign patent documentation found the following:

In the patent application P-42/99, published on Jul. 10, 2001, entitled "Chemical agent for fire extinguishing by powder", the applicant, company VISAN from Zemun, presented a procedure for the production of a fire extinguishing agent by powder which satisfies the possibility of fire extinguishing on electrical devices under voltage, and in addition it is completely non-poisonous and non-harmful for humans and materials, resistant to freezing with the possibility of extinguishing at the lowest temperatures, and it also enables the extinguishing of all types of fires of class A, B, C, D and E. This powder, except for hand-held fire extinguishing appliances, is also intended for use in fire-extinguishing vehicles, on stable installations of high capacity with automatic activation. According to the invention, the powder is a homogeneous mixture of finely sulphonated bicarbonate, calcite, magnesite, alumina and talc.

In the international Greek patent application PCT/GR97/00028, published on Jan. 29, 1998, entitled "Fire extinguishing products", of the applicant INNOVAL MANAGEMENT LIMITED, Int. Trade Center Building, 126 Curacao, Netherlands Antilles, there is a mixture presented for fire extinguishing which consists of multiprocessing polymers or copolymers of macromagnetic structure, which allows the introduction of ionic groups at high density and the absorption of large amounts of water up to 300 gr. water/gr. polymer intermolecular, which is released by combustion, decomposition of the product or under pressure. According to the invention, for ease of operation, it may contain detergents, emulsifiers, adhesives and inorganic materials, e.g. calcium carbonate, sulphates, silicate in a minced form that do not burn and cannot be mixed, and they are useful in extinguishing the fire.

In the application of patent P-422/94, published on Aug. 22, 1997, the applicants Ristić Dimitrije and Miloš from Novi Beograd presented "Fire Extinguishing Systems" which function by activating an explosive by the proximity lighter which by activation forms a shock wave that reacts together with fine particles of retardation and performs localization, control and fire extinguishing. This system is in the form of a bomb and it consists of a carrying cord, a proximity lighter connected by a solid non-metallic connection to the metal tube where the explosive is located, and it is welded to the reservoir. This fire protection system is intended for use in military operations, in the field of mining and chemical plants, and it is also suitable for extinguishing and localization of the fire of large proportions, especially large fuel reservoirs and other flammable devices which are dangerous to approach. In addition, they are also intended for the localization of fire on airplanes, hangars and facilities with rack systems, etc.

In Russian patent number RU2230587 (C1) published on Jun. 20, 2004, the applicant presented a technical solution entitled "Powder composition for filling fire extinguishing appliances". The powder is used for fire extinguishing on pipelines, rooms with electrical equipment, basements, bunkers, etc. and the components it is made of are hexachlorparaxylene in an amount from 5.0 to 35.0 mass. %, a pigment based on inorganic metal oxide in an amount of 5.0-6.0% by weight, fine silicon dioxide of 0.1 to 2.0% by weight, sorbitol 0.5 to 5.0% by weight, used in ration from 1:2.5 to 1:5, and the rest is azodicarbonamide.

In the Chinese patent application CN1093295 (A) published on Oct. 12, 1994, by the applicant Wuhan Fire Extinguish Science, entitled "Dry NaCl Based Powder and Procedure for its Production", a fire extinguishing agent is presented with a major component of NaCl granules size 670 microns, where the surface of each granule is coated with two layers of protective films obtained by the silicating process, so that the silicon powder and additive fill the space between these two films. The invention is characterized by the fact that the raw materials for its production are easily procured, the cost of production is low, and the extinguishing agent presents high efficiency, moisture resistance, greater resistance to longer storage and non-use, and it is suitable for all appliances that use NaHCO3 dry powder and can extinguish fires in classes B, C and D.

In an acknowledged German patent DE102016113554 (B3) published on Jul. 22, 2016, an invention entitled "Composition of a powder for extinguishing fire and preventing the spread of fire" is presented, which contains the modifiers which increase the powder liquidity and its elasticity as well as super-absorption polymers-density enhancers, so when the powder dissolves in water, it forms a three-dimensional structure, thereby increasing viscosity. This way, the obtained gel is suitable for extinguishing the fire and for preventing the spread of fire. The three-dimensional gel structure shows viscosity and fluidity that enable it to flow smoothly through standard fire extinguishing equipment and thus create the possibility of retaining on vertical and horizontal surfaces, including hanging surfaces. On the treated area after evaporation of the water from the gel, due to the heat of the fire, a crust is formed as an additional protective layer that prevents the spread of the fire and the re-occurrence of the flame.

Analyzing the existing technical solutions shown in the available patent documentation as well as similar powders of specialized companies for the production of equipment and fire extinguishing agents, it prevents them from happening or slowing down the burning of materials that would possibly come into contact with the flame, because it was considered to be highly applicable, selective, depending on the type of fire, and therefore expensive and non-ecological with harmful consequences of fire extinguishing because they are obtained through complicated technological processes, after long-term testing and experimentation, the author came to a widely applicable natural and unharmful agent which resolves the above defined technical issue.

SUMMARY OF THE INVENTION

According to the author's idea, the essence of the invention is that the mixture is obtained in the form of a fire extinguishing powder for extinguishing the fires of A, B, C, D, F or K class consisting of substances based on a combination of finely minced and specially treated components, zeolites, vermiculite, alumohiydrates, sepiolite, calcite, talc and alumina, which satisfy the highest standards for complete non-toxicity, harmlessness for humans, animals, plants and treated area, and at the same time they have a high extinguishing power with almost instantaneous flame elimination.

The essence of the invention is also represented by the fact that its use efficiently substitutes on the market widely represented powders produced from a mixture of sodium sulfate, ammonium sulfate, ammonium phosphate, and similar, which are used in various percentages, wherein the ammonoammonium phosphate constitutes a minimum of 20% to 96% MAP, and the rest is most commonly sodium sulphate which has irritative effect and damages the mucous membrane, and which are also known to be the serious pollutants of the environment, as well as the phosphates.

The novelty of the invention is also reflected in the fact that the powder also substitutes the fire extinguishing powders for the B and C classes of fire, where the percentage of the key components is sodium-hydro-carbonate or potassium-hydro-carbonate and urea is from 70-90%, while the powder contains an optimal proportion of potassium hydrocarbonates, ranging from 20-30%, and the rest are minerals sepiolite, zeolite and aluminum hydrate, which in this combination make it an environmentally safe dry powder that successfully extinguishes (neutralizes), besides B and C class of fire, F class and K class of fire also.

The essence of the invention is also that, according to the present recipe, the powder is composed of 85-95% of natural mineral raw materials, so it can also be used for suppression catastrophic fires, especially forest fires, where there are no harmful effects nor the negative relapses of extinguishing on treated objects and surfaces.

The novelty of the invention is also reflected in the fact that the present fire extinguishing powder is resistant to freezing and the has the possibility of extinguishing fire even at the lowest temperatures, which expands the spectrum of effects to all types of class A, B, C, D and F fires and/or K (class F is a mark in the EU and class K in the United States and includes fires of plant and animal oils and greases, such as fryers oils and greases, kitchen frying and roasting systems, etc.).

The novelty of the invention, in comparison to similar known products, also means that after carrying out the primary function (fire extinguishing), the preparation in burnt areas realizes its second-order function of enriching the soil and promoting the revitalization and growth of plant crops, since there are minerals in the fire extinguishing powder, taken from nature, and they are used as natural ecological preparations in the process of cultivation of plants.

The thing that makes this invention fundamentally different from the widely used fire extinguishers is its property of an efficient absorbent of organic and other materials that enables it to maximize the absorption of harmful organic matter through occasional accidents, for example spillage, oil burning and/or its derivatives on water and other surfaces, whereby the absorbed material floating on the surface of the water is easily collected and then sent for recycling to the appropriate facilities.

The essence of the invention is also that the fire extinguishing powder is successfully used in case of catastrophic forest fires, since the components of which it is made provide a high flowability—mobility and anti-hygroscopicity, which reflect in the prolonged inhibitory effect towards the heat. The principle of the effect of powder is carried out by removing heat in the treated terrain first, and then creating a protective layer—a stain that does not allow the formation of flames again, acting as a thermo-insulating material.

The novelty of the invention is also the fact that the powder is intended for the use by aviation (military and civilian), and with this the highest speed of action can be achieved, which is one of the most important factors for an effective fire extinguishing effect, which is not only the rationalized costs related to the amount of fire extinguishing agent used, but as well as the costs related to the use of people, firefighting vehicles, appliances and other fire extinguishing devices and the number of aircraft overflights covering the whole area affected by fire. In addition, a quick reaction of fire extinguishing significantly reduces material and ecological damage.

The novelty of the invention is also that, according to the assessment of the method of use, besides the conventional fire extinguishing devices, the distribution of the powder in question is intended for use by cluster bombs—dispensers containing special cartridges, whereby such modified bombs may be of a different weight, depending on the surface the fire extinguishing powder in question should cover.

Compared to previously known technical solutions, which are similarly engaged in the fire extinguishing issue and the retarded action of the burning process, i.e. the special materials finding special for faster, safer and more efficient fire extinguishing, the present invention has several advantages, the most significant are as follows:

- it is ecologically acceptable, because when heated and evaporated it does not make any matter dangerous or harmful for the human health, animals and plants;
- after the treatment of the area, there is no any crust, and the dust becomes hygroscopic and remains permanently on the ground;
- low production cost and simple application to all known classical agents that used water as the mean of extinguishing.
- when using larger quantities, dust protects the firefighters from heat of radiation, and in most cases no special protective equipment is required,
- used for extinguishing at a wide temperature interval of −50° to +60° C.,
- considerably higher durability and longevity,
- does not damage to objects and things, so it is suitable for extinguishing fire in museums,
- the powder cloud operates by forming the isolation from the electrical current,
- it can be transported through long hoses and pipelines.

BRIEF DESCRIPTION OF DRAWINGS

In order to understand the invention more easily, authors refer to the attached drawings of the application, only for example, where:

FIG. 1, presents the technological scheme of obtaining the subject powder procedure.

DETAILED DESCRIPTION OF THE INVENTION

It is known that the burning of some matter will cease when all of the combustible conditions are eliminated. It is also known that the effects of a fire extinguisher can be:

- extinguishing (when the fire extinguishing matter is inserted into the fire spot in the form of gas, fog, powder or foam, thereby covering the burning surface and preventing partial or complete access to oxygen from the air, thus eliminating one of the conditions of burning);
- cooling, which means that fire extinguishing agent is brought in the center of a fire and it takes the heat away from the combustible matter (at the moment when the temperature of the combustible matter is reduced below the flammable temperature, the combustion process automatically stops);
- anti-catalytic, arising from the ability of the agent to be used for extinguishing by preventing the combustion (oxidation) of the combustible material with the oxygen.

The basic idea of the author, realized through this invention, is based on the identification of such an extinguishing agent that will, to a greater or lesser extent, function on all three effects of extinguishing, enabling effective extinguishing of class A, B, C, D, F and K. In the realization of this idea, they began from the fact that for the ability to extinguish the fire by powder the most important influence is the grain size and the turbulent movement of the powder. Dry matter extinguishing fire primarily by interrupting chain chemical reactions of the fire that means the presence of free radicals in the flame zone, wherein the free radicals react with the fuel and with oxygen and improve the further flame reactions and an increase the number of free radicals. Fine particles of dry chemicals brought into the flame range capture enough free radicals and this way they interrupt the chain reaction and fire extinguishing occurs almost immediately, so-called anti-catalytic effect. The cloud of the dry chemical looks like a partition through which the flame cannot pass from the cloud of particles when their concentration is appropriate. Conversely, when a cloud of dry chemical is produced where the reaction of the combustion is already in progress, extinguishing occurs. In the application of dry chemicals, the size of powder particles that are used for extinguishing is very important. Binding the free radicals to the surface of the particles is the basic factor in breaking the chain reaction. If the powder is finer, the more effective surface area for the given quantity of agents is, so the distance of the free radical diffusion is shorter. In addition, it is important to have in mind that the effectiveness of extinguishing depends on the specific surface area of the dry powder, the shape of the grain and other substances that synergistically positive influent the fire extinguishing efficiency, as well as the technological procedure for the production of the powder in question. To obtain the necessary fineness of powdered chemicals, a "micronizer" method is used, which produces particles with a maximum size of 50 microns, where the cohesion forces between the particles of the compound occur in this form are disturbed. In the dry components obtained by this method, the particles are smooth and, as such, suitable for extinguishing the fire by powder.

The chemicals processed by the "micronizer" process are additionally modified by neutral chemicals, e.g. polysilicon and/or stearates in order to improve hydrophobicity, for which in the invention they used zeolite, vermiculite, potassium bicarbonate, calcium carbonate, magnesium carbonate, metallurgical alumina, hydrated alumina, called aluminum (three9 hydroxide—hydrate and talc, whose active working provides the fluidity and mobility to powder material and its anti-hygroscopic properties. The anti-hygroscopicity of the powder is achieved by the fact that the grain of the powder is wrapped in a thin film of a polymeric additive, and the flowability is achieved by the addition of silicates and carbons. Also, by using these components, the inhibitory effect on heat is also achieved. For example, by adding a precisely measured fine-grained metallurgical alumina (which is in the composition of gamma $Al_2O_3$ and alpha $Al_2O_3$), as well as alimo-hydrates, the powder does not make smoke and it is the flame inhibitor. When exposed to fire, the alimo-hydrate is endothermically dissolved to water and anhydrous aluminum oxide. In this case, the water cools the fire and significantly slows its degradation into combustible fuel, and because of the greater specific gravity compared to other ingredients, the alumina covers the places with embers (class A), coats them with a layer and takes a certain amount of heat. Calcium carbonate or magnesium carbonate, in addition to giving powder the fluidity, in the extinguishing process, have a similar effect as the alumina, and in addition, they cover the ember spots with a thin layer where, due to the effect of temperature, partial decarbonization reaction occurs. By using talc, besides increasing the flowability, a thermo-insoluble effect has been achieved by successfully extinguishing Class D and E of fires. The powder also present has the vermiculite whose characteristic is that at the temperature that it creates, the ember is dissolved or it expands, increasing its volume by more than 15 times, and as it belongs to thermal insulating materials, as well as talk that gives powder its flow, it additionally accelerates the fire extinguishing process.

Zoolite (clinoptilolite) is also present in the mixture, which is specially treated to produce positive characteristics in fire extinguishing and significantly participates in the revitalization of the soil, especially during the extinguishing of forest fires. Specially treated zeolites exhibit an effect, which is reflected in the fact that at a temperature i.e. calcination at 400 to 500° C. they release absorbent water without disturbing the structure. This way, an additional fire extinguishing function is achieved, where the cavities are released in the zeolite, ready for the absorption of other molecules. The volume of micropores produced this way depends on the structure of the zeolite and the number and nature of cations.

In order to increase the powder efficiency, modified minerals, combined with neutral hemicycles and their salts, were used in its composition, which additionally improved its properties, by making the active powder surface hydrophobic and it is well known that the structures and properties of such organic films on the surface of their particles have a considerable influence on the final properties of the composite because they represent the interface between the two components in the heterogeneous material. The modification of the material is carried out in air space of countercurrent mixer, and before the start of modification process, the modification samples are inserted into the dryer and are subjected to heat treatment, i.e. drying for up to 70° C. for 20 min. and then the amount of neutral chemicals for modification is then added to the dispersion. The modification time is from 10-30 min. depending on the amount of material for modification. The technical process of production starts with the division of the components into the precision balance 4 according to the recipes shown in the various implementation of the invention, after this, the precisely measured amounts of raw materials in the quantitative ratios shown in the description of the invention are brought into crusher 5 where they are grinded until the powder is obtained to a granulation of maximum 50 microns. After grinding, the resulting mixture is subjected to drying treatment, i.e. the drying process in standard dryers 6 and then it is put into the mixer 7 where it is subjected to the modification process, i. e. refining by neutral chemicals. The mixer 7 and the pre-seeded mixture are first heated to 70° C., and then the certain amounts of neutral chemicals for modification are added by spraying. The process of modification lasts 10-30 minutes, depending on the amount of modifying material, after which a homogenised powder and it is packed in a natron bags 10, of a weight of 25 kg or in large bags of 11 to 1000 kg, and then it is stored in solid and dry warehouses 9 in accordance with the N615 standard that regulates this area. Filling the powder into the appropriate appliances or other distribution devices transported to the point of fire is carried out in accordance with ISO 7202. This powder is re-sampled and then sent to the laboratory for testing the quality of finished products.

Based on many years of laboratory and practical testing, it was observed that the powder composition, in order to obtain the best results and achieve greater efficiency, should be quantitatively and qualitatively modified, i.e., adapted, depending on its own purpose in fire protection. Based on such testing and experimentation, the inventor has shown several variants in the present invention:

Variant 1

Fire extinguishing agents of class A, B, C, D (solid porous materials, flammable liquids, fuel gases and light metals) is a mixture of the following composition:

| | | |
|---|---|---|
| 22-35 mas. % | aluminum (three) hydroxide ($Al(OH)_3$— dry hydrate) | max 50 microns |
| 7-13 mas. % | metallurgical alumina | max 50 microns |
| 7-13 mas. % | vermiculite | max 50 microns |
| 12-17 mas. % | zeolite | max 50 microns |
| 3-7 mas. % | sepiolite | max 50 microns |
| 7-13 mas. % | calcium carbonate ($CaCO_3$) | max 50 microns |
| 7-13 mas. % | potassium bicarbonate ($KHCO_3$) | max 50 microns |
| 7-13 mas. % | talc | max 50 microns |
| 2-4 mas. % | calcium stearate | max 5 microns |
| 2-4 mas. % | polysiloxane | max 5 microns |

The process of obtaining the powder according to this variant consists in the following: previously carefully selected starting materials are prepared by precise measuring and accurately measured mass percentages into the crusher, where they are subjected to the "micronizer" process to obtain a granulation up to a size of 50 microns.

The resulting mixture is subjected to heat treatment after grinding, i.e. the drying process in standard dryers and then it is put into the mixer where it is subjected to the modification process, i. e. refining by neutral chemicals. The mixer and the pre-crushed mixture are first heated to 70° C., and then they are then the dosed amounts of neutral chemical for modification is added by spray. The process of modification lasts 10-30 minutes. In this way, homogenized powder was obtained by stirring.

Variant 2

Fire extinguishing agents of class A, B, C, D (solid porous materials, flammable liquids, fuel gases and light metals) are a mixture of the following composition:

| | | |
|---|---|---|
| 22-35 mas. % | aluminum (three) hydroxide ($Al(OH)_3$— dry hydrate) | max 50 microns |
| 12-17 mas. % | metallurgical alumina | max 50 microns |
| 17-25 mas. % | vermiculite | max 50 microns |
| 17-25 mas. % | zeolite | max 50 microns |
| 7-13 mas. % | talc | max 50 microns |
| 2-4 mas. % | calcium stearate | max 5 microns |
| 2-4 mas. % | polysiloxane | max 5 microns |

The process of obtaining the powder according to this variant is the same as in the previously described variant only in the process of obtaining the above-mentioned raw materials are present in pre-calibrated percentage proportions.

Variant 3

Fire extinguishing agents of class A, B, C, D (solid porous materials, flammable liquids, fuel gases and light metals) is a mixture of the following composition:

| | | |
|---|---|---|
| 22-35 mas. % | aluminum (three) hydroxide ($Al(OH)_3$— dry hydrate) | max 50 microns |
| 7-13 mas. % | metallurgical alumina | max 50 microns |
| 7-13 mas. % | calcium carbonate ($CaCO_3$) | max 50 microns |
| 13-17 mas. % | talc | max 50 microns |
| 27-35 mas. % | zeolite | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

Variant 4

Fire extinguishing agents of class A, B, C, D (solid porous materials, flammable liquids, fuel gases and light metals) is a mixture of the following composition:

| | | |
|---|---|---|
| 22-35 mas. % | aluminum (three) hydroxide ($Al(OH)_3$— dry hydrate) | max 50 microns |
| 25-35 mas. % | metallurgical alumina | max 50 microns |
| 7-13 mas. % | calcium carbonate ($CaCO_3$) | max 50 microns |
| 17-23 mas. % | talc | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

Variant 5

Fire extinguishing agents of class A, B, C, D (solid porous materials, flammable liquids, fuel gases and light metals) is a mixture of the following composition:

| | | |
|---|---|---|
| 33-37 mas. % | vermiculite | max 50 microns |
| 17-23 mas. % | aluminum (three) hydroxide ($Al(OH)_3$— dry hydrate) | max 50 microns |
| 7-13 mas. % | calcium carbonate ($CaCO_3$) | max 50 microns |
| 7-13 mas. % | talc | max 50 microns |
| 17-23 mas. % | metallurgical alumina | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

Variant 6

Fire extinguishing agents of class A, B, C, D (solid porous materials, flammable liquids, fuel gases and light metals) is a mixture of the following composition:

| | | |
|---|---|---|
| 33-37 mas. % | vermiculite | max 50 microns |
| 17-23 mas. % | zeolite | max 50 microns |
| 7-13 mas. % | aluminum (three) hydroxide ($Al(OH)_3$— dry hydrate) | max 50 microns |
| 7-13 mas. % | talc | max 50 microns |
| 17-23 mas. % | metallurgical alumina | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

Variant 7

Fire extinguishing agents of class B, C, F and K (flammable liquids, fuel gases, and plant and animal oils and fats) used as an absorbent is a mixture of the following composition:

| | | |
|---|---|---|
| 33-37 mas. % | sepiolite | max 50 microns |
| 17-23 mas. % | zeolite | max 50 microns |
| 17-23 mas. % | potassium bicarbonate ($KHCO_3$) | max 50 microns |
| 7-13 mas. % | aluminum (three) hydroxide ($Al(OH)_3$— dry hydrate) | max 50 microns |
| 7-13 mas. % | talc | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

Variant 8

Fire extinguishing agents of class B, C, F and K (flammable liquids, fuel gases, and plant and animal oils and fats) used as an absorbent is a mixture of the following composition:

| | | |
|---|---|---|
| 47-53 mas. % | sepiolite | max 50 microns |
| 13-17 mas. % | zeolite | max 50 microns |
| 17-23 mas. % | potassium bicarbonate ($KHCO_3$) | max 50 microns |
| 3-7 mas. % | aluminum (three) hydroxide ($Al(OH)_3$— dry hydrate) | max 50 microns |
| 3-7 mas. % | talc | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

Variant 9

Fire extinguishing agents of class B, C, F and K (flammable liquids, fuel gases, and plant and animal oils and fats) used as an absorbent is a mixture of the following composition:

| | | |
|---|---|---|
| 43-47 mas. % | sepiolite | max 50 microns |
| 17-23 mas. % | zeolite | max 50 microns |
| 17-23 mas. % | potassium bicarbonate ($KHCO_3$) | max 50 microns |
| 7-13 mas. % | talc | max 50 microns |
| 2-4 mas. % | calcium stearate | max 5 microns |
| 2-4 mas. % | polysiloxane | max 5 microns |

The process of obtaining the powder according to this variant is the same as in the previously described variant only the above-mentioned raw materials in pre-calibrated mass percentages are present in the process of obtaining.

The previously described variants and methods of obtaining, fire extinguishing powder was obtained, which successfully solves the defined technical problem, whose distribution to the place of application, or to the place affected by the fire is carried out by various fire extinguishers by powder. These appliances are made of the most suitable steel tin, they are in cylindrical shape and welded construction, and are applied in six sizes depending on the predetermined amount of charge, whereby smaller appliances S-1, S-2 and S-3 are intended for fire extinguishing at motor vehicles, and larger devices S-6, S-9, S-12, S-50 i S-100 are made for fire extinguishing of liquid matters (gasoline, oil-benzene, alcohol, ether, varnish, oil, etc.) and fires on electrical devices and high and low voltage installations. Regardless of the size of the fire extinguisher, by using the powder in question, the range of the jet increases and reaches a maximum of 3 m, and the rest of the powder in the tank, which is not discharged until the end of the continuous discharge, in this case is maximum 10% of the original quantity. In order to allow powder in these fire extinguishers to pass through the pipes and to create a powder cloud, a power device is necessary. As power agents, gases are used under pressure, and those gases are $CO_2$, $N_2$ and air, considering that there is the need to have carbon dioxide, $CO_2$, in hand-held fire extinguishers, while in vehicles and with stable fire extinguishers as a powder-evacuating agent we use nitrogen, $N_2$ and in very rare occasions, we use air. The mass value of the gas must be indicated on the bottle. Deviation allowed for this weight is not more than ±10% of the indicated value. The standard allows the powder to be under the constant pressure of the pressure gas from 12 to 14 bars. In this case, the pressure value and the discharge area must be visible on the indicator, at a temperature of 20° C.

Especially in the application of the present invention, it is necessary to emphasize that this powder is extremely effective for recovery from catastrophic forest fires. Namely, it is known that these fires are characterized by high spreading speed, so in their extinguishing the most important factors are the time and speed of action. Time, in the sense when the fire is noticed and how much did it spread before that moment, and the speed of the action that prevents further spread of the fire and its extinguishing. In this sense, the inventor for the purpose of extinguishing these fires by the mentioned powder, especially determined the use of military and civil aviation, because this way the speed of action was achieved at the highest possible level. The use of aviation allows the action on inaccessible and remote areas, to which the usual firefighter units have difficult or no access, and in such cases, so this method of fire extinguishing is the most effective. In situations where several simultaneous fires occur and in the conditions of strong winds and storms, only aviation has the necessary movability in the fight against forest fires. By this method of application of the subject invention, a significantly higher efficiency was achieved in the extinguishing of fire compared to any other means or use of similar powders, primarily because of the significantly higher coverage power. This also means that using the pre-dust powder reduces the number of required take-offs, and more significantly, it also achieves significant savings in terms of the means of transport for the engagement of aviation.

Using aviation, according to the invention, a number of other advantages are achieved, such as:

- fire is attacked quickly before it increases the speed of movement,
- The fire is attacked in places that are often temporarily unavailable to the firefighters due to the configuration of the terrain,
- the possibility of significantly of more precise application of a large quantity of extinguishing agent in a short time interval is achieved,
- greater mobility of action is achieved, whereby the attack on the fire is transferred quickly from place to place, with the aim of hitting the most critical hot spots and calming of fire points.

In order to prove the efficiency of the invention, the inventor gave an example of the use of Martin Mars plane, with a capacity of 27,000 liters of water that can cover an area of 4 hectares. It is known that over 50% of water often does not reach a fire, and the problem of extinguishing on the ground itself is challenging due to the presence of deposits of dry twigs, humus, etc. By using this plane for fire protection purposes, the distribution of the fire extinguishing agent is carried out by using cluster bombs-dispensers, which in this case contain appliances, i.e. patrons of "bombs" weighting, for example, 6 kg (net fire extinguishing powder). Each of these appliances separately sprays the agent and covers an area of 20 $m^2$. This means that the cluster bomb carrying 4 dispensers of 1 t with this filling covers an area of at least 8 hectares (4000 biodegradable cartridges×6 kg of our ecologically safe biodegradable ABC fire extinguishing powder=24,000 kg, i.e. 4,000×20 $m^2$=80, 000 $m^2$ or 8 ha) which, compared to the effect of other technical solutions of a similar profile, presents significantly higher efficiency and ability to cover the fire affected terrain with extreme precision. The efficacy of the powder in question is easily noticeable if the following data is taken into account: by using this powder, for example, 24,000 kg i.e. 4,000×20 $m^2$ the fire protection on 80,000 $m^2$ or 8 ha is achieved.

In addition, it should be noted that the components of the powder in question are based on completely natural raw materials and meet the strictest ecological conditions, so that after the initial fire extinguishing function, the treated land is enriched and the revitalization of the plants in the burning areas is stimulated. In addition, this powder has a higher cover power and is more efficient compared to similar powders, which means that a smaller amount of powder used can extinguish the larger areas affected by fire.

It should also be emphasized that, in the case of A, B, and C classes of fire, powders based on of ammonium phosphate are used, which cause harmful effects to the environment. Thus, for example, in widely used fire extinguishing powders, there are the following chemicals: sodium sulfate, ammonium sulfate, ammonium phosphate, and others in various mass percentages and ratios where, for example, the monoammonium phosphate makes min. 20% to 96%, and the rest is the most common sodium sulfate, which is proved to have irritating and harmful effects on the mucous membrane, and in addition, it is well-known that phosphates are serious pollutants of the environment, as well as sulfates. On the contrary, using the powder in question, consisting of 85-95% of natural mineral raw material, the process of extinguishing takes place without any harmful consequences and negative relapses of the extinguishing.

INDUSTRIAL AND OTHER INVENTION METHODS OF USE

Industrial or other method of obtaining and applying a fire extinguishing powder according to the present invention is absolutely possible according to the parameters set forth in this description.

Experts from the subject area may, without any problems, carry out the production procedure of the powder in question, using this description, mentioning that it belongs to the type of ecological means that are used without any harmful effects on humans and the surrounding living world.

In accordance with good results of experimental testing, on various materials, the application of the present invention is recommended for extinguishing and preventing fires of A, B, C, D, F or K class. Due to its high efficiency, it is especially recommended to use this agent for extinguishing large fires, that is, to prevent fire from occurring at those sites where there is a high possibility of fire. By combining various measures, by applying the construction of fire protection zones and fireproof barriers in the fire directions, it is possible to use this product according to the invention, especially if it is used with the help of modern means that are now a part of firefighter's equipment, in order to prevent or significantly reduce the consequences of fire. With the use of this agent, according to the invention, it is possible to create an effective fire barrier which completely supplements preventive (controlled) burning or cleaning of surfaces which, as the rule says, have long-lasting harmful effects on the areas where these measures were applied.

The application of the present invention is particularly recommended in accidental situations, especially in cases of catastrophic, large forest fires at those sites where there is a great possibility of fire and where the efficiency of the operation of firefighting units is significantly reduced due to the configuration of terrain, i.e. inaccessibility, and especially in conditions of strong winds and storms fires when the speed of fire extinguishing is important, and in these situations the drone monitoring is used with the use of civil and military aviation with especially remodified cluster bombs and cartridges that are individually sprayed, so that the powder more efficiently covers a significantly higher fire affected areas.

The invention claimed is:

1. Fire extinguishing powder for extinguishing A, B, C, D, F and K classes of fire, characterized by the fact that the composition of the mixture is according to the following: 22-35 mass % aluminum (three) hydroxide ($Al(OH)_3$—dry hydrate), 7-13 mass % metallurgical alumina, 7-13 mass % vermiculite, 12-17 mass % zeolite, 3-7 mass % sepiolite, 7-13 mass % of calcium carbonate ($CaCO_3$), 7-13 mass 2% potassium bicarbonate ($KHCO_3$), 7-13 mass % talc, 2-4 mass % calcium stearate and, 2-4 mass % polysiloxane, said fire extinguishing powder mixture obtained by precisely measured mass percentages of aluminum (three) hydroxide (AL(OH)3—dry hydrate), metallurgical alumina, vermiculiet, zeolite, sepiolite calcium carbondate (CaCO3), potassium bicarbonate (KHCO3;) and talc, that are put into a crusher, where they are subjected to a "micronizer" process to obtain the granulation size of up to 50 microns, and after that, the grained mixture is subjected to heat treatment, (i.e. the drying process in standard dryers 6) and then the grained mixture is put into a preheated (70° C.) mixer 7, and then precisely measured quantity of calcium stearate and polysiloxane neutral chemicals for modification is then added by spraying, and then the grained mixture is stirred for 30 minutes and after this procedure the resulting homogenized powder is removed from the mixer and packed in natron bags weighing 25 kg or in larger bags weighing up to 1000 kg and then the bags are stored.

2. A fire extinguishing powder for extinguishing A, B, C, D, F and K classes of fire comprising a mixture of the following: 22-35 mass % aluminum (three) hydroxide ($Al(OH)_3$—dry hydrate), 7-13 mass % metallurgical alumina, 7-13 mass % vermiculite, 12-17 mass % zeolite, 3-7 mass % sepiolite, 7-13 mass % of calcium carbonate ($CaCO_3$), 7-13 mass 2% potassium bicarbonate ($KHCO_3$), 7-13 mass % talc, 2-4 mass % calcium stearate and, 2-4 mass % polysiloxane, wherein said mixture is obtained by loading the aluminum (three) hydroxide (AL(OH)3—dry hydrate), metallurgical alumina, vermiculiet, zeolite, sepiolite, calcium carbondate (CaCO3), potassium bicarbonate (KHCO3;) and talc into a crusher, where they are subjected to a process resulting in granules having a size of up to 50 microns, and subjecting the granules to a drying process, and further combining with the granules calcium stearate and polysiloxane.

3. A natron bag comprising the fire extinguishing powder of claim 2.

4. A method of extinguishing a fire comprising applying the fire extinguishing powder of claim 2.

* * * * *